United States Patent [19]

Matsui et al.

[11] Patent Number: 4,537,019

[45] Date of Patent: Aug. 27, 1985

[54] SPLICED JOINT OF SPUN YARNS

[75] Inventors: Isamu Matsui; Hiroshi Mima, both of Kyoto, Japan

[73] Assignee: Murata Kikai Kabushiki Kaisha, Japan

[21] Appl. No.: 359,789

[22] Filed: Mar. 19, 1982

[30] Foreign Application Priority Data

Mar. 25, 1981 [JP] Japan ..... 56-44547

[51] Int. Cl.[3] ..... D01H 15/00

[52] U.S. Cl. ..... 57/202; 57/22

[58] Field of Search ..... 57/22, 23, 202, 261

[56] References Cited

U.S. PATENT DOCUMENTS 3,867,810 2/1975 Meertens et al. ..... 57/202

4,240,247 12/1980 Matsui et al. ..... 57/22 X 4,263,775 4/1981 Mima ..... 57/22

4,341,065 7/1982 Baumgartner ..... 57/22

*Primary Examiner*—Donald Watkins

*Attorney, Agent, or Firm*—Spensley Horn Jubas & Lubitz

[57] ABSTRACT

A structure of a joint of spun yarns formed by lapping the tops of two yarn ends in the untwisted state and jetting a compressed fluid to the lapped portion while keeping the tops of the yarn ends free without securing the tops of the yarn ends. In at least one portion of the joint, fibers of the two yarn ends are integrated to form one yarn having twists of the same or opposite twisting direction as or to the twisting direction of inherent twists of the spun yarn.

13 Claims, 18 Drawing Figures

SPLICED JOINT OF SPUN YARNS

BACKGROUND OF THE INVENTION

The present invention relates to a joint formed by splicing two spun yarn ends.

As the conventional knot of a spun yarn, there can be mentioned knot represented by fisherman's knots and weaver's knots, and knots formed by using a paste. The knots of the former type are formed by bending spun yarns in various manners, and any change of twists is not considered. In these knots, the yarns are clamped to each other by the yarns per se to fix the knot, and the binding strength is determined by the strength of this clamping, the size of the yarn ends projecting outwardly from the knot and the inherent strength of the yarn. Accordingly, a delicate adjustment is necessary for obtaining a desirable binding strength. The size of the knot is about 3 times the size of the spun yarn. Furthermore, at the winding step, a certain time is required for one rotation of a mechanical knotter bill. In knots of the latter type, spun yarn ends are arranged in parallel and bonded together by a paste, and therefore, any change of twists need not be taken into account. In the knot of this type, the yarn ends are secured to each other by using a quick-dry paste, and it is an important condition how fast the paste is dries at the winding step.

SUMMARY OF THE INVENTION

The present invention relates to a joint formed by splicing two spun yarn ends.

The present invention, more specifically, relates to the joints which are formed by lapping the tops of two yarn ends in the untwisted state and jetting a compressed fluid to the lapped portion while keeping the tops of the yarn ends free without securing the tops of the yarn ends.

An object of the present invention is to provide a joint of a spun yarn which is substantially different from the foregoing conventional knots in not only the structure but also the characteristics. More specifically, the present invention provides a joint having a high binding strength, which is formed by lapping both the yarn ends in the untwisted state and jetting a compressed fluid to the lapped portion to integrate, entangle and twist untwisted fiber of the yarn ends.

According to the present invention, in the region of the joint, fibers are integrated and entangled with one another to form a portion wherein the fibers are twisted in the same direction of the yarn or a portion wherein the fibers are twisted in the direction opposite to the inherent twisting direction of the yarn, and on both the ends of the region of the joint, ends of untwisted fibers are entangled in the same direction as the swirling direction of the compressed fluid to form wrapping fibers.

The size of the joint of the present invention is much smaller than the size of the conventional mechanical knot and the average joint strength is about 80% of the strength of the single yarn. The joint of the present invention is not caught by a knitting needle at the knitting step since wrapping fibers are entangled with the surface on both the end portions of the joint.

DETAILED DESCRIPTION OF THE INVENTION

The present invention will now be described in detail with reference to embodiments illustrated in the accompanying drawings.

FIGS. 1 through 5 show embodiments of the joint of a spun yarn according to the present invention. The principle condition for the production of the joint of the present invention is that both the yarns constituting the joint are spliced in the state where specific portions of the yarn ends are untwisted and the top portions of the yarn ends are not clamped but kept free. Accordingly, in the formed joint, the untwisted fibers are entangled with one another and the fiber ends are includes into the inner yarn layer and are twisted, as if one twisted yarn were formed, and the top portions of both the yarn ends are entangled with each other to form portions of wrapping fibers entangled at a random angle in the same direction as the swirling direction of the fluid on both the ends of the joint. In short, the joint of the present invention comprises said twisted yarn portion and end portions of said wrapping fibers.

Figure 1:
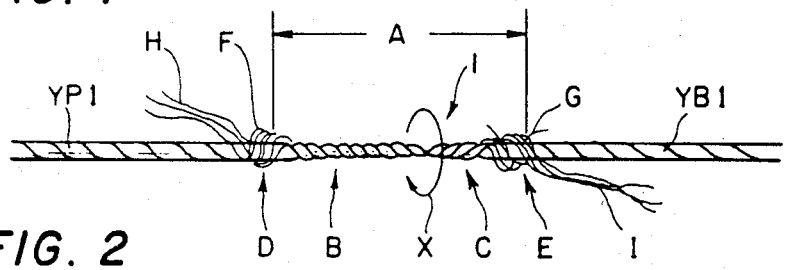
FIGS. 1 through 5 are diagrams showing embodiments of the joint according to the present invention.
Figure 6:
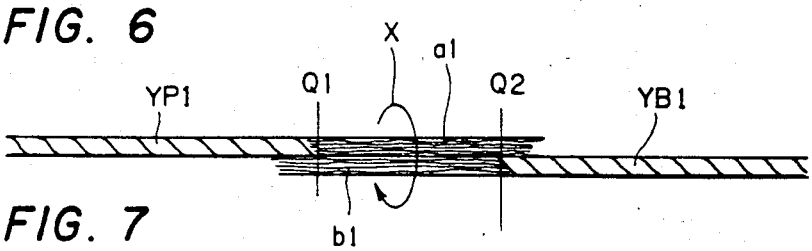
FIGS. 6 through 9 are diagrams showing lapped portions of yarn ends for formation of the joints shown in FIGS. 1 through 5.

In a joint 1 between a yarn end YP1 from the package side and a yarn end YB1 from the bobbin side, as shown in FIG. 1, a portion A of the joint comprises a portion B twisted in the same direction as the twisting direction inherent twists (Z twists in FIG. 1) of the spun yarn and a portion C twisted in the direction opposite to the inherent twisiting direction, and wrapping fibers F and G are formed on both the end portions D and E of the joint A and hairy projections H and I are formed on the tops of the yarn ends. As shown in FIG. 6, both the yarn ends YP1 and YB1 are lapped together in the state where the length of the untwisted portions a1 and b1 is long and the tops of the yarn ends are located outwardly of the yarn pressing positions Q1, and Q2. If the center of the lapped portion is swirled in this state in the direction of an arrow X by the action of a compressed fluid, fibers of the untwisted yarn ends a1 and b1 are entangled with one another by the jetting action of the compressed fluid, and the tops of the fibers of the yarn end a1 are intruded in and integrated with the fiber bundle of the yarn end b1, and the lapped portion is then twisted by the swirling stream of the fluid and it is formed into one twisted yarn. By swirling of the fluid in the direction X, the yarn end YP1 on the package side is turned so that it is further twisted in the inherent twisting direction. Accordingly, in order to prevent breakage by excessive twisting, the yarn end YP1 is lightly pressed and regulated for positioning by a yarn pressing member at the position Q1. In this case, twists additionally given are released through the yarn pressing member to the left of position Q1. On the other hand, the bobbin side yarn end YB1 is turned in the direction removing the inherent twists. Accordingly, the bobbin side yarn end YB1 is pressed by a yarn pressing lever at the yarn pressing position Q2 so that the untwisting action is not propagated toward the bobbin beyond the yarn pressing position Q2.

Accordingly, twists (S twists) opposite to the inherent twists are given to the bobbin side portion of the joint. Incidentally, the portion C twisted in the direction opposite to the inherent twisting direction is untwisted to some extent by the inherent twists when the yarn pressing is released, and the portion C is loosely twisted in some cases.

Figure 2:
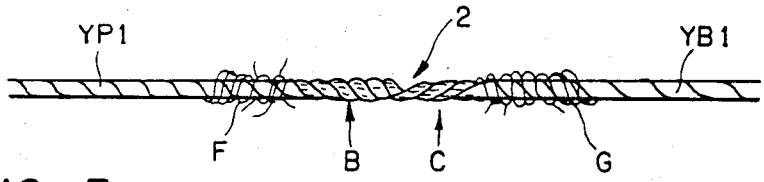
Figure 7:
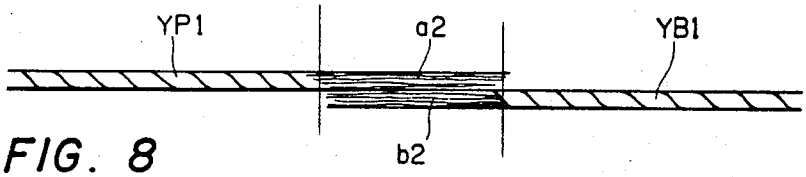

A joint 2 shown in FIG. 2 is similar to the joint 1 shown in FIG. 1, but hairy projections are not present on any of both the ends of the joint shown in FIG. 2. As shown in FIG. 7, in the lapped portion of both the yarn ends, untwisted top portions a2 and b2 of both the yarn ends are located inwardly of the yarn pressing positions Q1 and Q2, and both the untwisted top portions are sufficiently subjected to the swirling action of the compressed fluid stream, and the entanglement of wrapping fibers on both the ends of the joint is much more enhanced than in the joint shown in FIG. 1. The joint portion A comprises the portion B of twists of the same twisting direction as the inherent twisting direction and the portion C of twists of the twisting direction opposite to the inherent twisting direction. Since the top portions of the yarn ends are sufficiently turned in the swirling direction of the compressed fluid stream, the quantities of twists in the portions B and C are much larger than in the joint 1 shown in FIG. 1.

Figure 3:
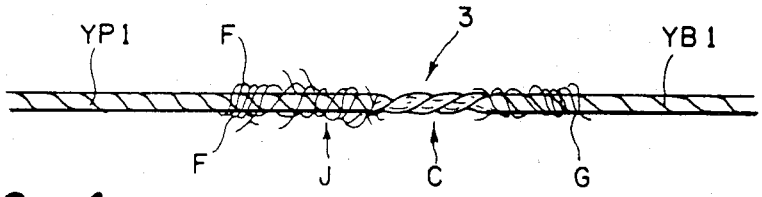

FIG. 3 shows a joint 3 in which the bottom yarn is additionally twisted and which comprises a portion J of fibers of one untwisted yarn and entangled on the bottom yarn and a portion C integrated with the bottom yarn and twisted in the direction opposite to the inherent twisting direction. On both the ends of the joint 3, there are present wrapping fibers F and G entangled in the same direction as the swirling direction of the compressed fluid stream.

Figure 8:
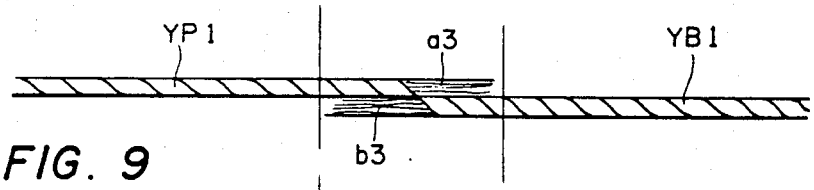

This joint 3 shown in FIG. 3 is readily formed when both the yarn ends are lapped as shown in FIG. 8. More specifically, the length of untwisted portions a3 and b3 of both the yarn ends is about $\frac{1}{2}$ of the distance L between the yarn pressing position Q1 and Q2, and the untwisted fibers a3 and b3 are lapped together only in the central portion of the range between the yarn pressing positions Q1 and Q2.

If this lapped portion is subjected to the action of the compressed fluid stream, the package side yarn end YP1 is further twisted, and therefore, the fibers of the yarn end YP1 are not untwisted or disentangled and they are not integrated with untwisted and disintegrated fibers b3 of the bobbin side yarn end YB1. Accordingly, parts of the fibers b3 may be twisted into the peripheral portion of the bottom yarn YP1 but they are ordinarily entangled with the bottom yarn. The bobbin side yarn end YB1 is turned in the direction removing the inherent twists by the swirling stream of the compressed fluid, and therefore, fibers a3 of the package side yarn end are integrated with the untwisted portion of the bobbin side yarn end and the integrated portion is twisted in the direction opposite to the inherent twisting direction to form a portion resembling one yarn. Fibers on the free tops of the yarn ends are entangled on both the ends of the joint in the same direction as the swirling direction of the fluid to form wrapping fibers.

Figure 4:
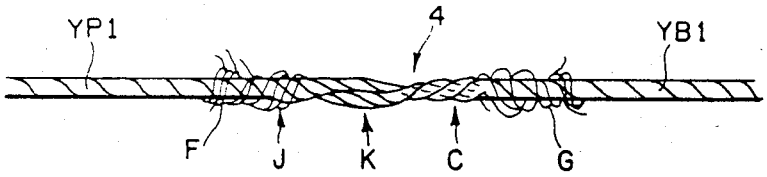

In a joint 4 shown in FIG. 4, the joint range A comprises a portion where the two yarn ends are separated and are arranged in parallel or loosely twisted together, a portion J in which fibers are entangled with the additionally twisted bottom yarn in the same direction as the swirling direction of the fluid and a portion C in which fibers of both the yarn ends are integrated and twisted in the direction opposite to the inherent twisting direction.

Figure 9:
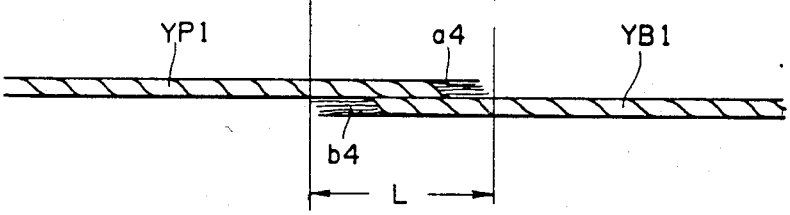

This joint 4 down in FIG. 4 is readily formed when the lapped portion of both the yarn ends is as shown in FIG. 9. In the case where the average length of fibers constituting the spun yarn is short, when both the yarn ends are untwisted by sucking and swirling the tops of the yarn ends by the untwisting nozzle pipe, disintegrated fibers are caused to fly out of the fiber bundle and the length of the portion of the remaining fibers become short. If such yarn ends a4 and b4 are lapped together, the yarn ends which are not disintegrated are lapped along a certain length at the center of the lapped portion and untwisted and disintegrated fibers a4 and b4 are present only in the vicinity of the yarn pressing positions Q1 and Q2.

If the lapped portion is subjected to the action of the compressed fluid stream in this state, the package side yarn end YP1 is turned in the same direction as the inherent twisting direction and hence, is additionally twisted, while the bobbin side yarn and YB1 is turned in the direction removing the inherent twists. As the result, in the range on the package side of the lapped portion, the lapped portion is untwisted, but fibers are not integrated with one another but fibers are entangled with the fiber bundle on the bobbin side. Thus, wrapping fibers are formed on the top of the bobbin side yarn end in the state where both the yarn ends are separated from each other. On the other hand, in the range on the bobbin side of the lapped portion, the non-disintegrated portion of the bobbin side yarn end is untwisted and disintegrated by the swirling stream, and the fibers of this portion are integrated with the fibers a4 of package side yarn end which have been disintegrated in advance, and the integrated fibers are twisted in the direction opposite to the inherent twisting direction to form one yarn-like portion. Simultaneously, there are formed wrapping fibers G entangled on the joint end in the same direction as the swirling direction of the fluid.

Figure 5:
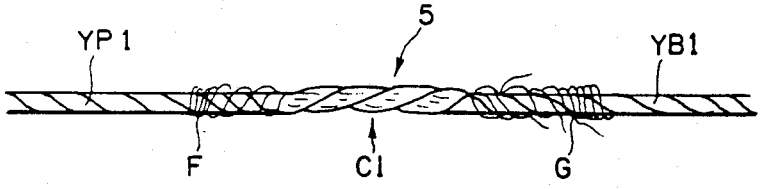

A joint 5 shown in FIG. 5 comprises a portion C1 twisted in the direction opposite to the inherent twisting direction along the entire range A of the joint and wrapping fibers F and G formed on both the ends of the joint. This joint is a modification of the joint 2 shown in FIG. 2. One yarn end is turned in the same direction as the inherent twisting direction and is additionally twisted, and the pressing lever located at the yarn pressing position Q1 to prevent breakage by excessive twisting merely exerts the function of positioning the yarn. On the other hand, since the other yarn end is turned in the direction opposite to the inherent twisting direction, and untwisting is caused. In order to prevent this untwisting from being propagated along the yarn, the yarn pressing plate is disposed at the yarn pressing position Q2. Accordingly, the fibers which are twisted and arranged in parallel are entangled with the fibers of said one yarn end, and the entangled fibers are twisted in the direction opposite to the inherent twisting direction by the swirling stream of the fluid. If this twisting in the opposite direction is strong, the twisting quantity is increased, and when jetting of the compressed fluid is stopped, the portion B twisted in the same direction as the inherent twisting direction is untwisted by the untwisting action of the portion C twisted in the direction opposite to the inherent twisting direction and the twists of the portion C in the opposite direction are propagated over the boundary between the portions B and C, and finally, the entire range of the joint is twisted in the direction opposite to the inherent twisting direction as shown in FIG. 5.

Other modes of the lapped portion than those shown in FIGS. 6 through 9 are considered. For example, in the case where one yarn end is located inwardly of the yarn pressing position Q1 and Q2 and the other yarn end is located outwardly of the positions Q1 and Q2, there may be formed a joint composed of a plurality of the joints described hereinbefore. Thus, various joints other than those mentioned above can be formed according to the present invention.

One embodiment of a splicing apparatus for forming the joint of the present invention will now be described.

Figure 10:
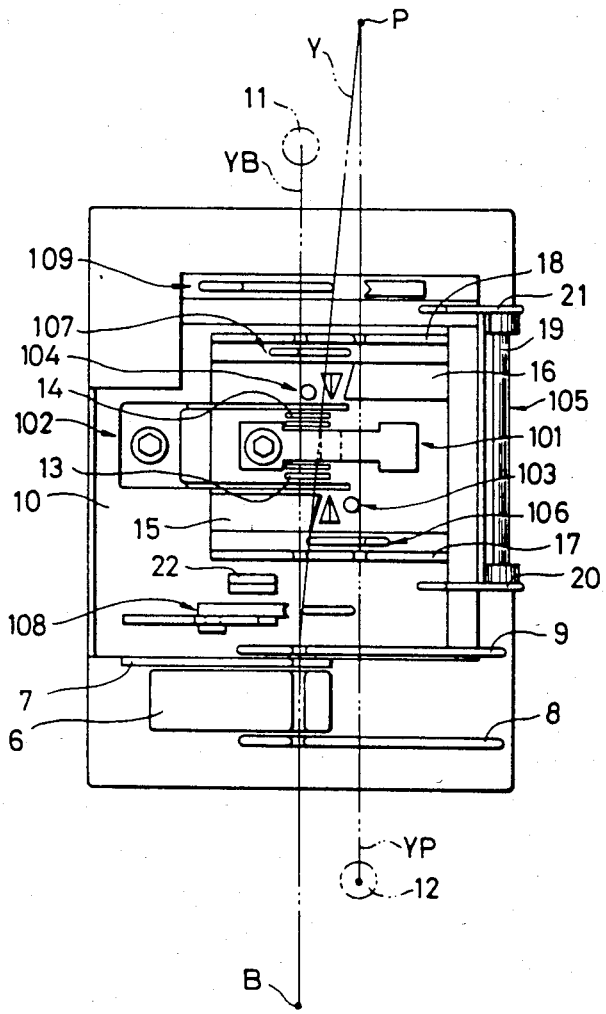
FIG. 10 is a front view diagrammatically illustrating the structure of a splicing apparatus for forming these joints.
Figure 11:
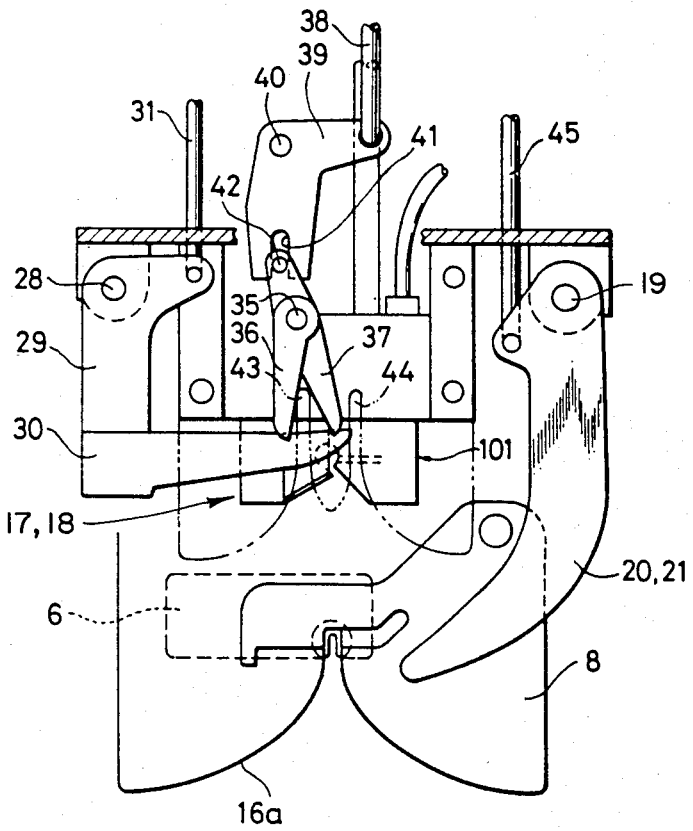
FIG. 11 is a plan view showing the apparatus of FIG. 10.

The entire structure of the splicing apparatus 10 is illustrated in detail in FIGS. 10 and 11. During the normal rewinding operation, the yarn Y is taken out from the bobbin B, is passed through the detecting device 6, a stationary guide 7 arranged on one end of the detecting device 6 and turnable guides 8 and 9 arranged on both the sides of the detecting device 6, travelled above the splicing apparatus 10 and wound on the package P.

The splicing apparatus 10 comprises as basic members a splicing member 101, yarn pressing device 102, untwisting nozzles 103 and 104, a yarn gathering lever 105, yarn cutting devices 106 and 107 and yarn clamping devices 108 and 109. First and second suction arms 11 and 12 are provided which can be turned and moved above the splicing apparatus 10 so that the suction openings on the top ends of the suction arms 11 and 12 intersect each other, whereat the first and second suction arms 11 and 12 suck the yarn ends YB and YP on the sides of the bobbin B and package P, move to the outside of the splicing apparatus 10 and stop there.

The splicing member 101 is arranged substantially at the center of the splicing apparatus 10, and on both the sides of the splicing member 101, there are arranged yarn guide pins 13 and 14, pressing device 102, untwisting nozzle pipes 103 and 104 and yarn guides 15 and 16. Furthermore, there are arranged yarn cutting devices 106 and 107 and fork guides 17 and 18 in sequence. A yarn gathering lever 105 comprising a supporting shaft 19 and levers 20 and 21 turning with the shaft 19 being as the fulcrum is arranged in the side portion of the splicing member 101. After the detecting device 6 detects a slub or other unevenness of the yarn Y to actuate a cutter not shown in the drawings to perform the cutting operation and the suction arms 11 and 12 are operated to guide the yarn ends YP and YB to the outside of the splicing apparatus 10, the yarn gathering lever 105 guides the yarn ends YP and YB toward the splicing apparatus 10. Incidentally, the turning range of the yarn gathering lever 105 is adjusted so that the yarn gathering lever 105 is stopped on abutting contact with a stopper 22 having a substantially V-shaped section, which is arranged between the fork guide 17 and the yarn clamping device 108. Accordingly, the turning range of the yarn gathering lever 105 can be adjusted by adjusting the position where the stopper 22 is mounted.

Figure 12:
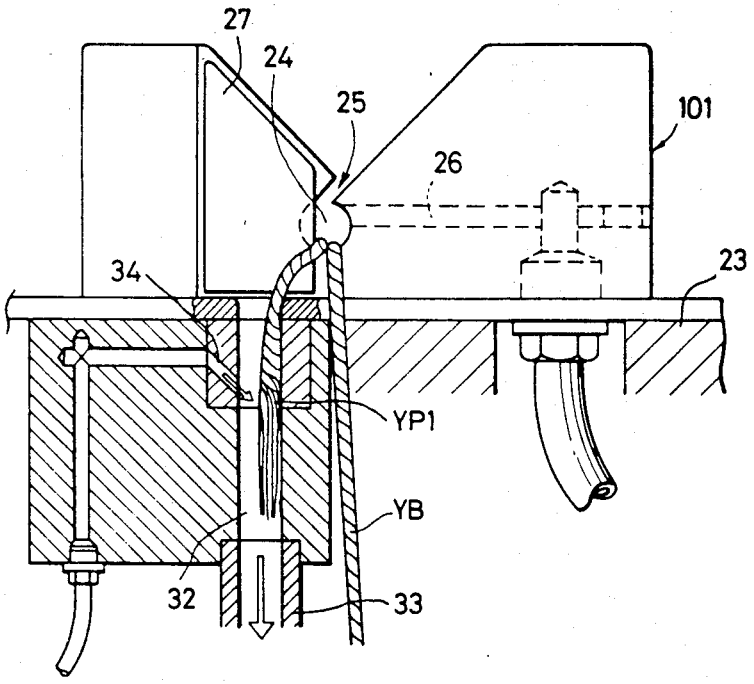
FIG. 12 is a partially sectional plan view showing a splicing member and an untwisting nozzle pipe.

Referring to FIGS. 11 through 12, the splicing member 101 arranged substantially at the center of the splicing apparatus 10 is secured to a bracket 23 through a screw, and a cylindrical splicing hole 24 is formed substantially at the center of the splicing member 101 and a slit 25 for insertion of the yarn Y from the outside is formed entirely along the tangential direction of the splicing hole 24. Furthermore, a jet nozzle hole 26 opened to the splicing hole 24 in the tangential direction is formed. In the present embodiment, the cylindrical nozzle hole 26 is formed substantially at the center of the splicing hole 24 in the longitudinal direction thereof. However, instead of this cylindrical nozzle hole 26, there may be formed a laterally expanded nozzle hole 26 having an ellipsoidal, rectangular or long-groove-like sectional shape or a plurality of nozzle holes 26. When the yarn to be spliced is thick, for example, when a yarn having a count number of 10 or more is spliced, especially good results can be obtained by using a nozzle hole having a laterally expanded section.

The splicing member 101 comprises balloon control plates 27 screwed through spacers, and the balloon control plates 27 are covering about a half of the section area of the splicing hole 24 in the present embodiment.

Referring to FIGS. 10 and 11, the pressing device 102 arranged on both the sides of the splicing member 101 cooperates with turning of the yarn gathering lever 105 at the splicing step to take out the yarn ends YP1 and YB1 untwisted by the untwisting nozzle pipes 103 and 104 and set them within the splicing hole 24 and simultaneously, the pressing device 102 controls the positions of both the yarn YP and YB. In the pressing device 102, a pressing plate 30 is screwed to a turning lever 29 turnable with a supporting shaft 28 fixed at a constant position being as the fulcrum and if a rod 31 is operated by a control cam not shown in the drawings, the pressing plate 30 is turned as shown in FIG. 13.

Figure 13:
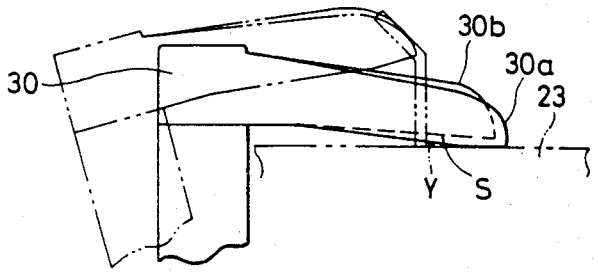

The yarn pressing plate 30 is illustrated in detail in FIG. 13. The pressing plate 30 has forked pieces extended to the top end, and these forked pieces are different to some extent in the shape. When the pressing plate 30 is turned and one forked piece **30*a* falls in abutting contact with the face of the bracket 23 to press the yarn Y among the top face of the bracket 23, the yarn guide pin 13 and the forked piece 30*a*, a certain space S allowing passage of the yarn Y is formed among the other forked piece 30*b*, the top face of the bracket 23 and the yarn guide pin 14**, whereby the position control is effected only in the direction traversing the yarn Y at a right angle.

The yarn pressing action of the forked piece **30*a* of the pressing plate 30** is performed to prevent return of twists caused by the action of a balloon formed on the yarn ends YB1 and YP1 by the action of the compressed fluid as described hereinbefore.

Accordingly, the degree of this pressing action is controlled to such an extent that twists on the yarn Y are not released by the action of the balloon. If this pressing action is too strong, fluffs are formed and no good results can be obtained. Since the other yarn Y is rotated in the twisting direction by the action of the balloon, this yarn need not particularly be held and it is sufficient if this yarn Y is pressed only to such a degree that the position thereof is controlled.

As shown in FIG. 12, a nozzle hole 32 for untwisting the yarn ends YB1 and YP1 is formed on each of the yarn untwisting nozzle holes 103 and 104 arranged on both the sides of the pressing device 102, and the yarn end YB1 on the side of the bobbin B and the yarn end YP1 on the side of the package P, which are to be spliced together, are guided into these nozzle hole 32 through the yarn splicing hole 24. Introduction of the yarn ends YB1 and YP1 is accomplished by the sucking action from an extended vacuum source through flexible pipes 33. When the yarn end YP1 is guided into its nozzle hole 32, a fluid is jetted from a jet nozzle 34 opened obliquely to the nozzle hole 32 to untwist the yarn end YP1 and arrange the respective fibers in parallel to one another. A similar untwisting is performed on the yarn end YB1 in its nozzle hole 32.

Referring to FIGS. 10 and 11, the cutting devices 106 and 107 have a scissor-like shape, and in each cutting device, a movable blade 37 is turned with a stationary pin 35 being as the fulcrum so that the movable blade 37 intersects a stationary blade 36, whereby the yarn Y is cut. When a rod 38 is actuated by a control cam not shown in the drawings, a bifurcate lever 39 is turned in the clockwise or counterclockwise direction with a shaft 40 being as the fulcrum, and the fork-like portion 41 of the lever 39 moves a supporting pin 42 on the other end of the movable blade 37, whereby the movable blade 37 is operated.

For guides 17 and 18 are arranged outwardly of the yarn cutting devices 106 and 107, and guide grooves 43 and 44 are formed on the fork guides 17 and 18, respectively.

The yarn gathering lever 105 arranged in the side portion of the splicing apparatus 10 is turned in the clockwise direction with a shaft 19 being as the fulcrum to introduce the yarns YP and YB into guide grooves 43 and 44 when a rod 45 is operated by a control cam not shown in the drawings.

The splicing operation in the above-mentioned apparatus will now be described.

Figure 14:
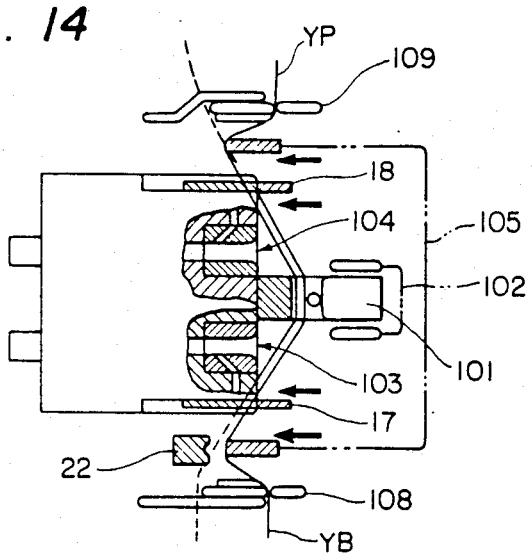

Referring to FIG. 14, both the yarns YB and YP are gripped by the clamping devices 108 ad 109, and the yarn gathering lever 105 is operated, by moving the rod 45 shown in FIG. 11, so as to move in the direction of an arrow through a control cam not shown in the drawings and turn the lever 20 and 21 in the counterclockwise direction with the shaft 19 being as the fulcrum. In this state, cutting of the yarn is performed. While the yarn gathering lever 105 and cutting devices 106 and 107 are operated, the yarn pressing device 102 is located in the state where the device 102 is turned in the clockwise direction with the shaft 28 being as the fulcrum by the operation of the rod 31.

Figure 15:
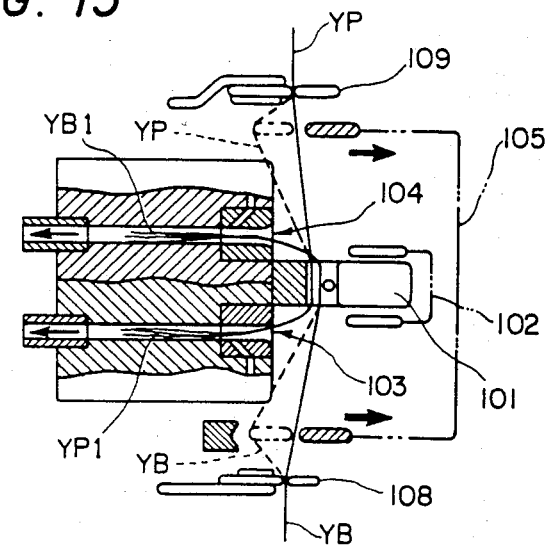

Then, as shown in FIG. 15, the yarn ends YB1 and YP1 are sucked by the untwisting nozzle pipes 103 and 104, and simultaneously or subsequently, the yarn gathering lever 105 is turned in the counterclockwise direction with the shaft 19 being as the fulcrum by the operation of the rod 45 as shown in FIG. 11, and is separated from the yarn. At this time, by the sucking action of the suction pipe connected through the flexible pipe 33, a compressed fluid is sucked in the nozzle hole 32 and is jetted from the jet nozzle 34, and the yarn ends YB1 and YP1 are untwisted in a state suitable for the splicing operation.

It is preferred that the sucking action by the untwisting nozzle pipes 103 and 104 be started just before the yarn is cut by the cutting devices 106 and 107. When the yarn Y is cut, a tension is given to the yarn by the suction arms 11 and 12, and hence, it sometimes happens that the yarn ends YB1 and YP1 are scattered from the positions of the untwisting nozzle pipes 103 and 104 and the sucking action of the untwisting nozzle pipes 103 and 104 are not imposed on the yarn ends YB1 and YP1. Accordingly, it is preferred that the untwisting nozzle pipes 103 and 104 be caused to act just before cutting of the yarn, though the untwisting nozzle pipes 103 and 104 may be operated simultaneously with or subsequently to cutting of the yarn. Supply of the fluid to the untwisting nozzle pipes 103 and 104 is accomplished by changeover of valves by solenoids not shown in the drawings.

Figure 16:
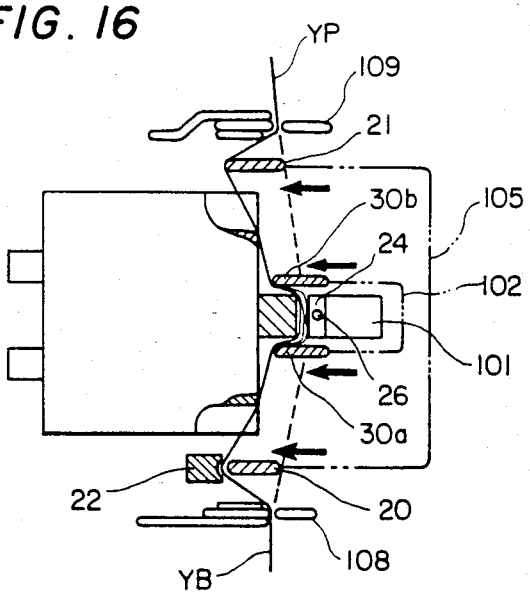
FIGS. 14 through 16 are diagrams illustrating the splicing operation in the splicing apparatus of FIG. 10.

When the yarn ends YB1 and YP1 are untwisted in a state suitable for the splicing operation by the untwisting nozzle pipes 103 and 104 and the sucking action of the untwisting nozzle pipes 103 and 104 is stopped, simultaneously or subsequently, the yarn gathering lever 105 is operated again as shown in FIG. 16, and one lever 20 is turned to the position abutting to the stopper 22 while guiding the yarn ends YB1 and YP1. Simultaneously, the yarn pressing device 102 is operated and turned to the position abutting to the bracket face 23 as shown in FIG. 13 while guiding the yarn ends YB1 and YP1. The yarn Y is pressed by one fork of the pressing plate 30, that is, the fork 30 on the side where the yarn Y is untwisted by the compressed fluid jetted from the jet nozzle hole 26 of the splicing member 101, so that untwisting of the yarn Y is prevented. On the other hand, the compressed fluid acts in the direction twisting the yarn on the side of the other fork **30*b***, and therefore, the yarn need not be particularly gripped and it is sufficient if the yarn is pressed to such an extent that the yarn position is regulated.

By the operations of the yarn gathering lever 105 and yarn pressing device 102, the yarn ends YB1 and YP1 inserted in the nozzle holes of the untwisting nozzle pipes 103 and 104 are gathered into the splicing hole 24 of the splicing member 101 and are set in the lapped state as shown in FIG. 16. At this time, the length of the joint to be formed by splicing is set by the turning distance of the yarn gathering lever 105. Accordingly, the turning distance of the yarn gathering lever 105 is adjusted according to the fiber length of the spun yarn.

In the state where the yarn ends YB1 and YP1 are thus set in the splicing hole 24, a compressed fluid is jetted from the jet nozzle hole 26, and splicing is effected by the action of the compressed fluid. After completion of the splicing operation, the yarn gathering lever 105 and yarn pressing device 102 are separated from the yarn Y, and the yarn Y is returned to the ordinary rewinding step through the slit 25 of the splicing member 101.

Appearances of joints formed according to the above-mentioned process are diagrammatically shown in FIGS. 1 through 5 and the structure of the joints has been mentioned above.

These joints 1 through 5 are formed by lapping the tops of two yarn ends in the untwisted state and jetting a compressed fluid to the lapped portion while keeping the tops of the yarn ends free without securing the tops of the yarn ends. In the region of the joint, fibers a1 through a4 and b1 through b4 are integrated and entangled with one another to form a portion B twisted in the same direction as the inherent twisting direction of the yarn and a portion C or C1 twisted in the direction opposite to the inherent twisting direction of the yarn, and on both the ends of the region of the joint, ends of untwisted fibers are entangled in the same direction as the swirling direction of the compressed fluid to form wrapping fibers G and F. The lengths of the portion B and the portion C may differ from each other and, indeed, one or the other may be absent from the resulting joint.

Figure 17:
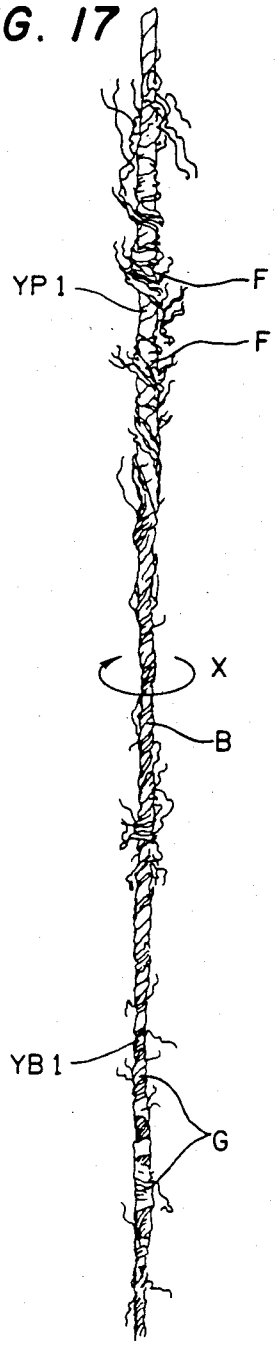
FIGS. 17 and 18 are diagrammatic reproductions of microscope photographs of actual joints.
Figure 18:
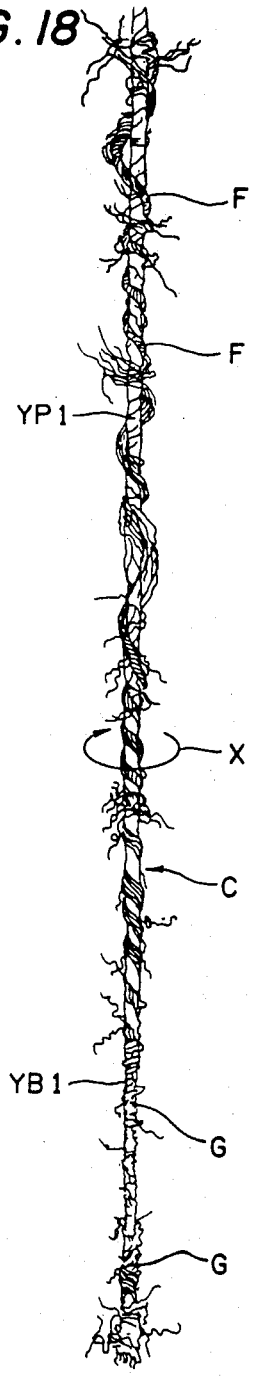

FIG. 17 is a diagrammatic reproduction of a microscope photograph of a joint of a cotton yarn of Ne 20 formed according to the above-mentioned principle. In this joint, one yarn-like portion B twisted in the same direction as the inherent twisting direction of the yarn is formed in the central portion of the joint, and the tops of both the yarn ends are entangled in the same direction as the swirling direction of the compressed fluid (direction X). More specifically, the top F of the bobbin side yarn end is turned and entangled in the direction opposite to the inherent twisting direction of the yarn, and the top G of the package side yarn end is entangled in the same direction as the inherent twisting direction of the yarn. FIG. 18 shows a joint of a cotton yarn of Ne 40, which comprises one yarn-like portion C twisted in the direction opposite to the inherent twisting direction of the yarn and wrapping fibers F and G entangled in the same direction as the swirling direction X of the compressed fluid.

Accordingly, the size of the joint of the present invention is much smaller than the size of the conventional mechanical knot such as a fisherman's or weaver's knot, and the joint of the present invention is not caught by a knitting needle at the knitting step. Furthermore, since wrapping fibers are entangled with the surface on both the end portions of the joint, the direction of twists need not be taken into account at the unwinding step. More specifically, untwisted fibers on the tops of both the yarn ends are strongly entangled and secured with one another by the swirling stream of the compressed fluid, and in the region of the joint, untwisted and disintegrated fibers are integrated with one another to form one twisted yarn-like portion. Accordingly, whether the drawing direction, that is, the running direction, of the yarn may be the left-to-right direction or the right-to-left direction in FIGS. 1 through 5, the yarn is travelled very smoothly without occurrence of yarn breakage or the like.

Joints were prepared according to the above-mentioned process by using various spun yarns of cotton, wool and synthetic fibers and mixed spun yarns thereof having a count number of from Ne 20 to Ne 60, and characteristics of the joints were determined. It was found that the average joint strength was 80% of the strength of the single yarn, the average elongation of the joint was 80% of the elongation of the single yarn and the average size of the joint was 1.2 times the size of the single yarn. Thus, it has been confirmed that the characteristics of the joint of the present invention are compariable to those of the single yarn.

What is claimed is:

1. A joint of a spun yarn, said yarn having an inherent twist direction, comprising:

a spliced region formed by overlapping two yarn ends of said spun yarn in opposing directions and jetting a compressed fluid centrally on the region of overlap such that fibers of the two yarn ends are integrated by swirling within the jetted compressed fluid, in a controlled manner, to form one yarn within the spliced region, said spliced region comprising:

a first joint portion, having twists in the same twisting direction as the twisting direction of inherent twists of the spun yarn; and a second joint portion, having twists in a twisting direction opposite to the twisting direction of inherent twists of the spun yarn;

and having wrapping fibers, formed of loose ends of the two yarn ends, entangled with one another around the spun yarn at adverse ends of the spliced region.

2. A joint of a spun yarn as claimed in claim 1, further comprising:

a third portion of the spliced region, disposed between said first and said second portions of the spliced region, wherein the two yarn ends are separated and are arranged to be substantially in parallel with each other or loosely twisted together without substantial mutual entanglement of the fibers of one yarn end with the other yarn end.

3. A joint of a spun yarn as claimed in claim 1, wherein said first joint portion of said spliced region has substantially zero extent and said second joint portion has an extent substantially along the entire range of said spliced region.

4. A joint of spun yarn having an inherent twisting direction, formed by substantially untwisting an extent of fibers of the ends of two yarn ends, overlapping said untwisted ends such that the loose untwisted ends of the two yarn ends each overlap with a segment of the other yarn end retaining the inherent twist of the spun yarn, pressing the overlapped yarns together at substantially each boundary between the untwisted extents and the spun yarns retaining the inherent twist, said pressing of the overlapped yarns serving to regulate the adjacent position of the overlapped yarn ends without rigidly holding said ends, and jetting a compressed fluid centrally on the region of overlap between the pressing positions such that fibers of the two yarn ends are integrated by swirling within the jetted compressed fluid to form one yarn having a first joint portion having twists of the same twisting direction as the twisting direction of inherent twists of the spun yarn, a second portion having twists in a twisting direction opposite to the twisting direction of inherent twists of the spun yarn, and having wrapping fibers, formed of loose ends of each of the two twisted yarn ends, entangled with one another around the spun yarn retaining the apparent twists at either end of the joint.

5. A joint of spun yarn having an inherent twisting direction, formed by substantially untwisting an extent of fibers of the ends of each of two yarn ends, overlapping said untwisted ends such that the loose untwisted extents are substantially parallel and coextensive in opposing directions, pressing each spun yarn adjacent to, but external of the region of overlap, said pressing serving to regulate the positioning of the overlapped spun yarns without rigidly holding said untwisted end extents, and jetting a compressed fluid centrally on the region of overlap such that fibers of the two untwisted yarn ends are integrated by swirling within the jetted compressed fluid to form one yarn having a first joint portion having twists in the same twisting direction as the twisting direction of inherent twists of the spun yarn, a second joint portion having twists in a twisting direction opposite to the twisting direction of inherent twists of spun yarn, and having wrapping fibers, formed of loose ends of each of the untwisted yarn ends, untangled with one another around the obverse ends of the joint.

6. A joint of a spun yarn having twists in an inherent twisting direction, formed by substantially untwisting an extent of fibers on the ends of each of two yarn ends, overlapping said yarn ends such that the untwisted extent of each of said yarn ends fully overlaps an extent of the other of said yarn ends containing said inherent twists, without overlapping said regions of said yarn ends retaining said inherent twists, pressing each spun yarn adjacent to, but external of the region of overlap, and jetting a compressed fluid centrally on the region of overlap such that fibers of the two untwisted yarn ends are swirled within the jetted compressed fluid to form one yarn having a first joint portion having fibers of the untwisted yarn end entangled with each other around the yarn end retaining twists in the same twisting direction as the twisting direction of inherent twists of the spun yarn, a second joint portion wherein the fibers of the untwisted yarn end of the other yarn end are integrated with the overlapped yarn end adjacent thereto and twisted in the direction opposite to the inherent twisting direction of the spun yarn, and having wrapping fibers, formed of loose ends of each of the untwisted yarn ends, entangled with one another around the obverse ends of the joint.

7. A joint of spun yarn, said spun yarn having twists in an inherent twist direction, formed by substantially untwisting an extent of fibers on the ends of each of two yarn ends, overlapping said yarn ends such that the untwisted extent of each of said yarn ends fully overlaps an extent of the other of said yarn ends retaining said inherent twists and such that said regions of said yarn ends retaining said inherent twists are also overlapped through an extent, pressing each spun yarn adjacent to, but external of the region of overlap, and jetting a compressed fluid centrally on the region of overlap such that fibers of the two untwisted yarn ends and the overlapped extent of the yarn ends retaining said inherent twists are integrated by swirling within the jetted compressed fluid to form one yarn having a first joint portion wherein one yarn end retaining inherent twists is swirled in the same direction as the twisting direction as the inherent twists while the adjacent untwisted yarn end fibers are entangled with each other and with the spun yarn retaining inherent twists, a second joint portion wherein the overlap extents of each of said yarn ends retaining said inherent twists are twisted about each other, a third joint portion wherein said yarn end retaining inherent twists is swirled in a direction opposite to the inherent twists such that fibers of the adjacent untwisted yarn end are integrated therein, and having wrapping fibers formed of loose ends of each of the untwisted yarn ends, entangled with one another around the obverse ends of the joint.

8. A method of forming a joint in a spun yarn, said spun yarn having an inherent twist direction, comprising the steps of:

(a) overlapping two yarn ends of the spun yarn in opposing directions through a splicing device;

(b) cutting the two yarn ends to provide substantially equal overlapped ends passing through said splicing device;

(c) substantially untwisting a terminal length of each of the cut yarn ends;

(d) adjusting the overlap of said yarn ends such that said untwisted terminal lengths are substantially within said splicing device;

(e) pressing the yarn ends external to each end of said yarn splicing device to regulate lateral motion of said yarn ends and untwisted lengths within said splicing device;

(f) swirling a jetted compressed fluid within said splicing device so as to cause said untwisted terminal lengths to interentangle, forming a joint having at least a first joint portion having twists in the same direction as the inherent twists of the spun yarn, a second joint portion having twists in a direction opposite that of the inherent twists of the spun yarn, and having wrapping fibers, formed from loose ends of the untwisted terminal lengths of the spun yarns, entangled with one another around spun yarn regions retaining twists in the inherent twist direction at obverse ends of the joint; and (g) removing the spun yarn having the joint formed therein from the splicing device upon completion of the swirling of step (f).

9. The method of forming a joint in a spun yarn as claimed in claim 8, wherein the overlap of the untwisted yarn ends of step (c) is adjusted in step (d) such that the pressing of step (e) engages the loose ends of the untwisted terminal lengths of each yarn end.

10. The method of forming a joint in a spun yarn as claimed in claim 8, wherein the overlap of the untwisted yarn ends of step (c) is adjusted in step (d) such that the pressing of step (e) engages only each spun yarn, respectively, leaving the overlapped untwisted terminal lengths free between the two pressing points.

11. The method of forging a joint in a spun yarn is claimed in claim 8, wherein the extent of the untwisted terminal length of each of the yarn ends of step (c) is established to be less than the distance separating the pressing points of step (e), and wherein the overlap of the yarn ends is adjusted in step (d) such that the untwisted terminal length of each yarn end extends from a point substantially centrally located in said splicing device substantially parallel with segments of the other yarn end retaining twists in the inherent twist direction.

12. The method of forming a joint in a spun yarn as claimed in claim 8, wherein the extent of the untwisted terminal lengths of each of the yarn ends of step (c) is established to be less than the distance separating the pressing points of step (e), and wherein the overlap of the yarn ends is adjusted in step (d) such that a segment of each yarn end retaining twists in the inherent twist direction is located centrally within a splicing device and the untwisted terminal lengths of each yarn end extend outwardly therefrom parallel with the other yarn end.

13. The method of forming a joint in a spun yarn as claimed in claim 8, wherein the pressing of the yarn ends of step (e) is established such that twists in the inherent twist direction imparted to the first joint portion by the swirling of the jetted compressed fluid in step (f) are allowed to propagate through the spun yarn from the splicing device through and beyond the pressing point adjacent the first joint portion, and such that twists in the direction opposite to the inherent twist direction imparted to the second joint portion by the swirling of the jetted compressed fluid in step (f) are precluded from propagating through the spun yarn beyond the pressing point adjacent said second joint portion.

* * * * *